US005245818A

United States Patent [19]

Scheufeld et al.

[11] Patent Number: 5,245,818

[45] Date of Patent: Sep. 21, 1993

[54] METHOD FOR CLEANING YARN SUPPLY PACKAGE PROTECTIVE POTS AND BALLOON LIMITERS OF SPINDLE ASSEMBLIES OF TWO-FOR-ONE TWISTER YARN PROCESSING MACHINES

[75] Inventors: Heinz Scheufeld, Korschenbroich; Ulrich Lossa, Krefeld, both of Fed. Rep. of Germany

[73] Assignee: Palitex Project Company GmbH, Krefeld, Fed. Rep. of Germany

[21] Appl. No.: 764,810

[22] Filed: Sep. 24, 1991

Related U.S. Application Data

[62] Division of Ser. No. 554,734, Jul. 18, 1990, Pat. No. 5,095,692.

[51] Int. Cl.[5] ..... D01H 11/00

[52] U.S. Cl. ..... 57/304; 57/300; 57/356

[58] Field of Search ..... 57/58.49, 58.52, 58.83, 57/300, 304-305, 306, 354, 356; 15/304

[56] References Cited

U.S. PATENT DOCUMENTS

| | | | |
|---|---|---|---|
| 3,662,532 | 5/1972 | Stahlecker | 57/58.89 |
| 4,125,991 | 11/1978 | Stahlecker | 15/304 |
| 4,127,983 | 12/1978 | Munker | 57/279 |
| 4,133,168 | 1/1979 | Keller, Jr. et al. | 57/304 |
| 4,135,354 | 1/1979 | Stahlecker | 57/304 |
| 4,137,700 | 2/1979 | Munker | 57/261 |
| 4,542,620 | 9/1985 | Kase et al. | 15/304 X |
| 4,548,030 | 10/1985 | Lauschke et al. | 57/302 |
| 4,856,268 | 8/1989 | Colli | 57/58.52 |
| 4,928,476 | 5/1990 | Otoshima et al. | 57/281 X |

FOREIGN PATENT DOCUMENTS

| | | |
|---|---|---|
| 2658441 | 6/1978 | Fed. Rep. of Germany . |
| 3824998 | 2/1989 | Fed. Rep. of Germany . |
| 471911 | 4/1969 | Switzerland . |

*Primary Examiner*—Daniel P. Stoloda
*Assistant Examiner*—William Stryjewski
*Attorney, Agent, or Firm*—Bell, Seltzer, Park & Gibson

[57] ABSTRACT

A method of cleaning a yarn supply package protective pot and, preferably, a balloon limiter device of a spindle assembly of a two-for-one twister yarn processing machine with a maintenance device mounted for movement longitudinally along the machine and to each of the spindle assemblies. The methods include moving a gripper device of a first cleaning device out of the maintenance device and into the protective pot of the selected spindle assembly for gripping and moving the protective pot out of the spindle assembly and into the maintenance device, while cleaning the protective pot in the maintenance device and then returning the protective pot to the spindle assembly. When the balloon limiter is also cleaned, a second cleaning device is moved out of the maintenance device and into the balloon limiter device of the spindle assembly while the protective pot has been removed and is being cleaned in the maintenance device. The balloon limiter is cleaned by the second cleaning device in the spindle assembly and the second cleaning device is then returned to the maintenance device and the gripper device of the first cleaning device then returns the cleaned protective pot to the spindle assembly.

2 Claims, 5 Drawing Sheets

METHOD FOR CLEANING YARN SUPPLY PACKAGE PROTECTIVE POTS AND BALLOON LIMITERS OF SPINDLE ASSEMBLIES OF TWO-FOR-ONE TWISTER YARN PROCESSING MACHINES

This application is a divisional of application Ser. No. 07/554,734, filed on Jul. 18, 1990, now U.S. Pat. No. 5,095,692.

FIELD AND BACKGROUND OF THE INVENTION

Cross-wound packages with a considerable length of a twisted yarn are produced on two-for-one twisters. Depending on the yarn count and the yarn twist per meter, which is connected therewith to a certain extent, the operating times for unwinding a full, untwisted yarn package range from 4 to 44 hours and more.

During such long operating times, it cannot be avoided that as a result of the process itself, or, however, as a result of processes linked to a two-for-one twister, dust and in part dirt accumulate in the two-for-one twister. Consequently, it is normal to equip such and also other machines, such as, for example, spinning machines, with traveling blow cleaners, which pass each working or twisting position at certain time intervals and keep certain areas of the machine free of too large accumulations of dust or dirt by applying air or suction currents. Although these measures are helpful, they are in most cases inadequate in two-for-one twisting spindles, since the yarn balloon forming during the two-for-one twisting process does not permit to reach certain areas of the machine. This applies in particular to the area of the spindles and, specifically, to the protective pot and the balloon limiter, but also to the spindle rotor itself.

When exchanging packages, i.e., creeling a twisting position, the aforesaid areas frequently undergo a preventive cleaning for this reason. This cleaning is often done by hand or by simple auxiliary means, for example, in the form of lint catchers. However, it is also normal to insert suction or air pipes by hand.

OBJECT AND SUMMARY OF THE INVENTION

It is the object of the present invention to provide for measures with regard to process and apparatus, so as to clean by an automated method especially endangered machine areas, such as the protective spindle pot, and/or balloon limiter, and/or spindle rotor, in particular in connection with the replacement, of a feed yarn package.

This object is accomplished in accordance with the present invention by providing a method of cleaning a yarn supply package protective pot of a spindle assembly of a two-for-one twister yarn processing machine having a plurality of such spindle assemblies mounted n side-by-side relationship longitudinally of the machine with a maintenance device. The maintenance device has a housing mounted for movement longitudinally along the machine to each of the spindle assemblies and cleaning means therein for cleaning the protective pot of each of the spindle assemblies including a gripper device for swinging in a horizontal direction out of and into the maintenance device housing and to move upward and downward and to grip and release the protective pot.

The method comprises the steps of positioning the maintenance device at a selected spindle assembly of the machine, moving the gripper device horizontally out of the maintenance device housing over the selected spindle assembly and downward into engagement with the protective pot, gripping the protective pot with the gripper device, moving the gripper device with the gripped protective pot upward out of the spindle assembly and horizontally into the maintenance device housing, cleaning the protective pot with the cleaning means while in the maintenance device housing, moving the gripper device with the gripped and cleaned protective pot horizontally out of the maintenance device housing over the selected spindle assembly and downward into the spindle assembly, releasing the protective pot from the gripping device, and returning the gripping device to the maintenance device housing.

Preferably, the method is also for additionally cleaning a balloon limiter device of each of the spindle assemblies. For this purpose, the maintenance device would include a second cleaning means therein for cleaning the balloon limiter device and which is adapted to swing in a horizontal direction out of and into the maintenance device housing and to move upwardly and downwardly. The above described method would include the additional steps of moving the second cleaning means horizontally out of the maintenance device housing over the selected spindle assembly and downward into the balloon limiter device after the gripper device of the first cleaning means has gripped and moved the protective pot out of the spindle assembly and into the maintenance device housing, cleaning the balloon limiter device with the second cleaning means while the protective pot is gripped and maintained out of the spindle assembly and in the maintenance device housing, and returning the second cleaning means to the maintenance device housing prior to moving the gripper device with the gripped and cleaned protective pot from the maintenance device and back into the spindle assembly for releasing the protective pot into the spindle assembly.

BRIEF DESCRIPTION OF THE INVENTION

The invention will be described hereinbelow in more detail, with reference to the drawing, in which.

DETAILED DESCRIPTION OF PREFERRED EMBODIMENT OF THE INVENTION

Figure 1:
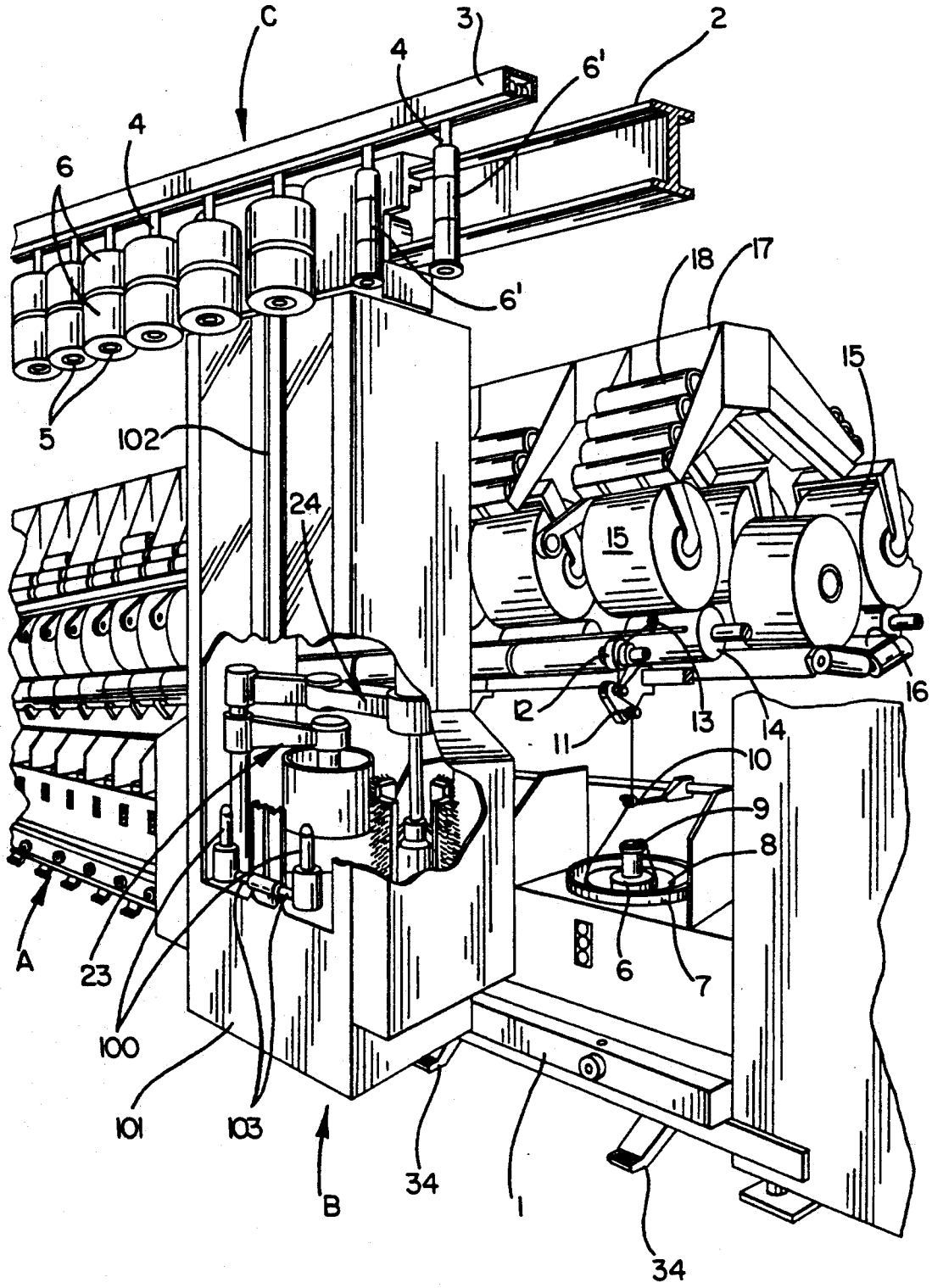
FIG. 1 is a perspective view of a portion of a two-for-one twister with an automatic maintenance device traveling along this machine.

FIG. 1 shows a portion of a two-for-one twister A, an automatic maintenance device B traveling along the two-for-one twister on lower and upper rails 1 and 2, and an overhead conveyor C.

The overhead conveyor C comprises an upper rail 3, along which a conveyor chain or belt extends with evenly spaced-apart, downward directed suspension holders 4 attached thereto for accommodating package adapters or package transport adapters 5. The suspension holders 4 and the package adapters 5 are constructed in known manner, so that during a first upward movement of the package adapter 5, the latter is grasped and held by the suspension holder 4, and released therefrom during a second upward movement and subsequent lowering relative to the suspension holder 4. FIG. 1 shows in the region of the upper rail 3, on the left side, six package adapters 5, each loaded with two fully cross-wound packages 6, which are to be delivered by the automatic maintenance device to the individual twisting positions of the two-for-one twister A, and on the right side, two package adapters 5, each holding two empty tubes 6', which were individually removed by the automatic maintenance device B from the twisting positions of the two-for-one twister A and delivered to a suspension holder 4. These tubes 6' are transported together with the package transport adapters 5 by means of the overhead conveyor 0 to an external loading station, where the adapters 5 can again receive fully wound feed yarn packages or cross-wound packages 6.

The two-for-one twister A comprises several working or twisting positions with the known standard elements, such as a spindle (not shown) in the lower portion, balloon limiter 7, protective pot s, yarn inlet end 9, balloon yarn guide 10, deflecting elements 11 for controlling the yarn winding tension, overfeed element 12, traversing yarn guide 13, and a cross-wound package of the twisted yarn or takeup package 15 driven by a friction roll 14. In the center of the machine, a conveyor belt 16 extends in the upper region between the two parallel, longitudinal sides of the machine for the removal of fully wound twister packages 15. Located above each cross-wound twister package or takeup package 15 driven by friction roll 14 is a magazine 17 for empty takeup tubes 18.

Shown inside the protective pot s is an upper, only partially cross-wound package or feed yarn package 6 of a pair of packages inserted into the twisting position. From the feed yarn packages, the yarns are withdrawn upward and guided through the yarn inlet end 9 into the lower spindle portion to a yarn storage disk, whence the two combined yarns advance to balloon yarn guide lo while forming a yarn balloon, and subsequently, after passing deflection rolls 11 and overfeed roll 12, onto a takeup package 15, which is driven by a friction roll 14.

The automatic maintenance device B routinely travels in front of the two-for-one twister A or its individual twisting positions. FIG. 1 schematically illustrates portions of two cleaning devices 23 and 24 integrated in the automat B, as well as mandrels 10D adapted to move upward and downward in vertical direction and serving as package and tube changing elements of a unit not shown otherwise, so as to insert package adapters loaded with full feed yarn packages into the individual twisting positions of two-for-one twisting spindles, on the one hand, and to remove again packages adapters loaded with empty or almost empty tubes from the two-for-one twisting spindles. The automatic maintenance device B comprises a cabinet-shaped housing 101, whose front wall is provided with a guide slot 102 for a rotatable cross arm 103, Which carries a mandrel 100. The mandrels 100 serve as transport elements for the package adapters between the overhead conveyor 0 and the lower portion of the automatic maintenance device B.

Figure 3:
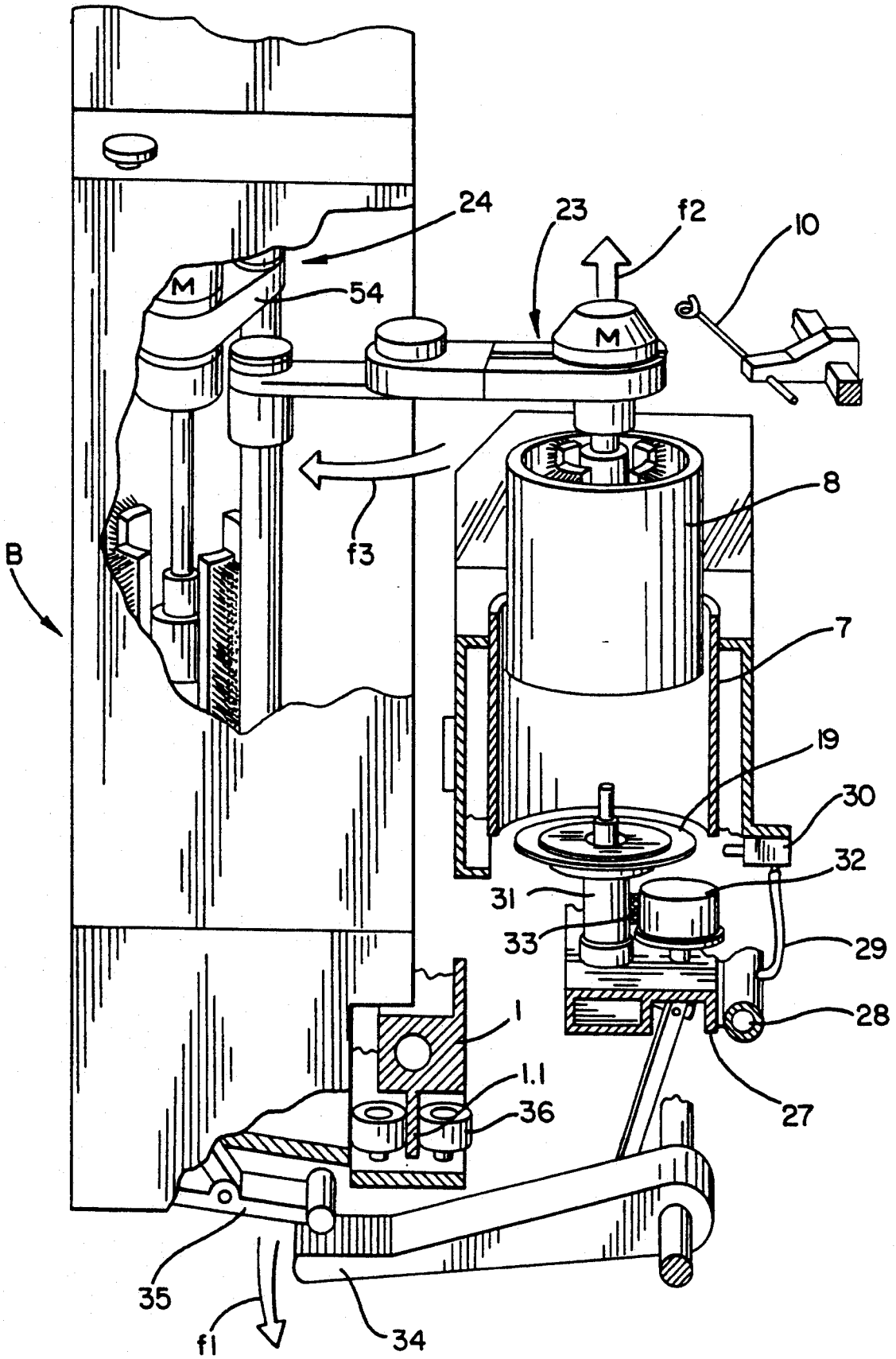
FIG. 3 is a partially sectional and partially perspective view of a portion of a two-for-one twisting spindle with two cleaning devices integrated in an automatic maintenance device in first operating positions.

FIG. 3 shows in addition the protective pot of a two-for-one twisting spindle as well as a standard Yarn storage disk 19. Further shown are a machine frame 27, a compressed-air line 28 with a connection 29 leading to a two-for-one twisting spindle and a nozzle 30 for a pneumatic threadup of the yarn. A spindle whorl 31 of the two-for-one twisting spindle is driven by means of a tangential belt 33, which is pressed against the whorl 31 by a belt pressure roll 32. A foot pedal 34 associated to each spindle serves to actuate a spindle brake not shown. Likewise, this pedal 34 serves to actuate the compressed-air nozzle 30, so as to build up in known manner a suction air current in the hollow spindle shaft for the purpose of threading the yarn through the spindle.

FIG. 3 further illustrates portions of the automatic maintenance device B, which patrols in front of the two-for-one twister along rails 1 and 2, and is provided with an actuation lever 35, which allows, when being depressed in direction of arrow f1, to actuate at a given moment the pedal 34 for the shutdown of the individual spindles. FIG. 3 shows, shortly above the pedal 34, two track rolls 36 which are guided along a surface 1.1 of the lower rail 1.

Referring to FIGS. 2–6, the description will now deal with the first and second cleaning devices of the present invention.

Figure 2:
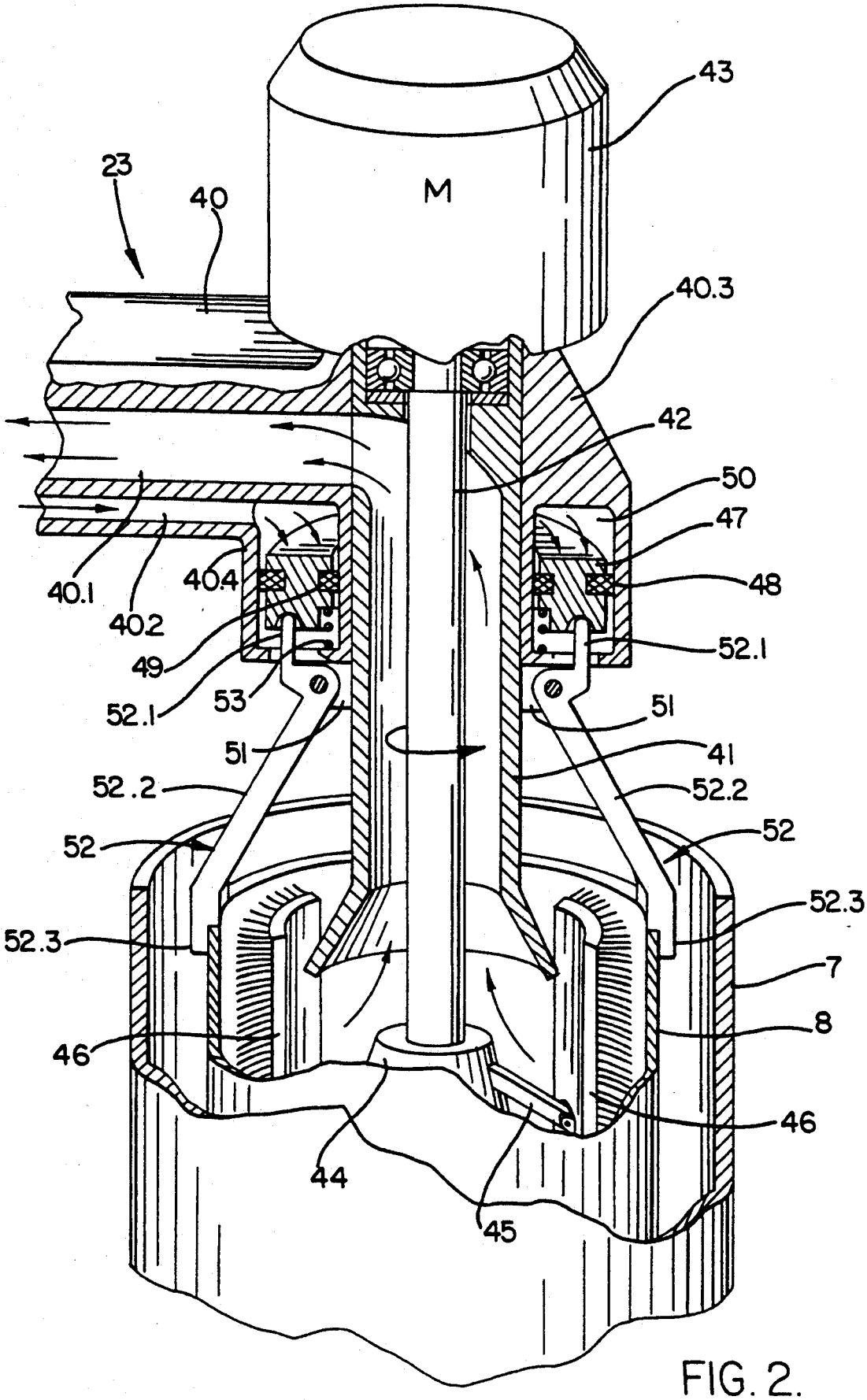
FIG. 2 is a partially sectional and partially perspective view of a portion of a two-for-one twisting spindle with a cleaning device associated thereto.

The first cleaning device 23, as shown in FIG. 2, serves to clean the protective pot s of a two-for-one twisting spindle. This first cleaning device 23 comprises a pivot arm 40, which is supported in the automatic maintenance device B and adapted to move upward and downward and to rotate about a vertical axis, and which accommodates in its interior a suction air line 40.1 leading to a source of vacuum not shown, as well as a compressed-air line 40.2 leading to a source of compressed air likewise not shown. Located at the end of the pivot arm 40 is a head piece 40.3, into which a suction nozzle 41 is inserted, which extends vertically downward and is connected to the suction air line 40.1 The lower end of the tubular suction nozzle 41 flares out in the form of a funnel. A drive shaft 42 of an electric motor 43 placed on the head piece 40.3 extends through the suction nozzle 41 coaxial therewith. The lower end of the drive shaft 42 carries a hub portion 44, to which vertically extending brush bars 46 are attached by means of radially extending, preferably rotatable arms 45.

The tubular suction nozzle 41 is surrounded by an annular cylinder 40.4 adjoining the head piece 40.3, into which an adjusting element in the form of an annular piston 47 is inserted, which is sealably guided in the annular cylinder 40.4 by means of packing rings 48, 49. Located above the annular piston 47 is a compressed-air chamber 50, which is connected with the compressed-air line 40.2.

On the outside of the suction nozzle 41, two-arm gripper levers 52 are rotatably supported by means of connecting pieces 51. Each gripper lever 52 has an upper lever am 52.1, whose end contacts the underside of the annular piston 47, as well as a lower lever arm 52.2, whose lower, free end is provided with an extension 52.3 adapted to move toward the upper edge of the protective pot s so as to grasp same.

To clean a protective pot s, the cleaning device 23 moves out of the automatic maintenance device to a centric position above the axis of the two-for-one twisting spindle. Subsequently, the cleaning device 23 is lowered, until the gripping extensions 52.3 contact the upper edge of the protective pot 8. Then, the annular piston 47 is lowered by the action of compressed air supplied into chamber 50, thereby moving the two lower, free lever arms 52.2 inward, so that the protective pot can be firmly grasped and secured against rotation. The electric motor 43 is then started, thereby causing the brush bars 46 inserted into the protective pot 8, to rotate and move along the inside wall thereof. Simultaneously, the suction air line 40.1 is connected to its source of vacuum, so that air laden with dust and dirt particles is sucked out of the protective pot and removed through the suction nozzle 41, if need be.

The brush bars 46 have a length corresponding to the height of the protective pot 8, it being possible, if need be, to arrange on the lower end of shaft 42 or respectively hub portion 44, radially extending, downward directed brush bars for cleaning the bottom of the protective pot.

Upon completion of the cleaning operation, the pressure in the compressed-air line 40.2 and the pressure chamber 50 is again decreased, so that the annular piston 47 moves upward by the action of a return spring 53, thereby permitting the gripper lever 52 to release the protective pot 8. Subsequently, the cleaning device moves out of the protective pot s, so as to then return to the region of the automatic maintenance device B.

Figure 5:
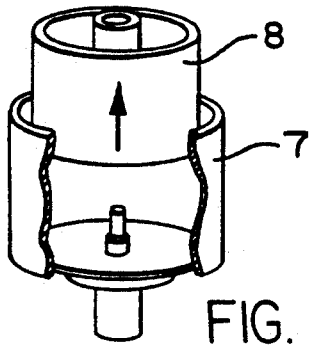
FIG. 5 is a schematic detail view of a two-for-one twisting spindle with a removable protective pot.

The operation as described with reference to FIG. 2 presumes that the actual cleaning operation is carried out in the region of the twisting position, i.e., the two-for-one twisting spindle. However, it is also possible to remove the protective pot s from the twisting position or two-for-one twisting spindle and to move same to the region of the automatic maintenance device, so that the actual cleaning operation can then be carried out inside the automatic maintenance device B. The removal of the protective pot s from the two-for-one twisting spindle is schematically illustrated in FIG. 3, it being presumed that the two-for-one twisting spindle is provided with a protective pot 8 removable from the balloon limiter 7, as is shown in FIG. 5.

The automatic maintenance device B itself may be an automat, which comprises, aside from the above-described cleaning device 23, a further cleaning device 24, if need be, which will be described below, as well as additional maintenance and handling elements, which allow to exchange packages and tubes.

Figure 4:
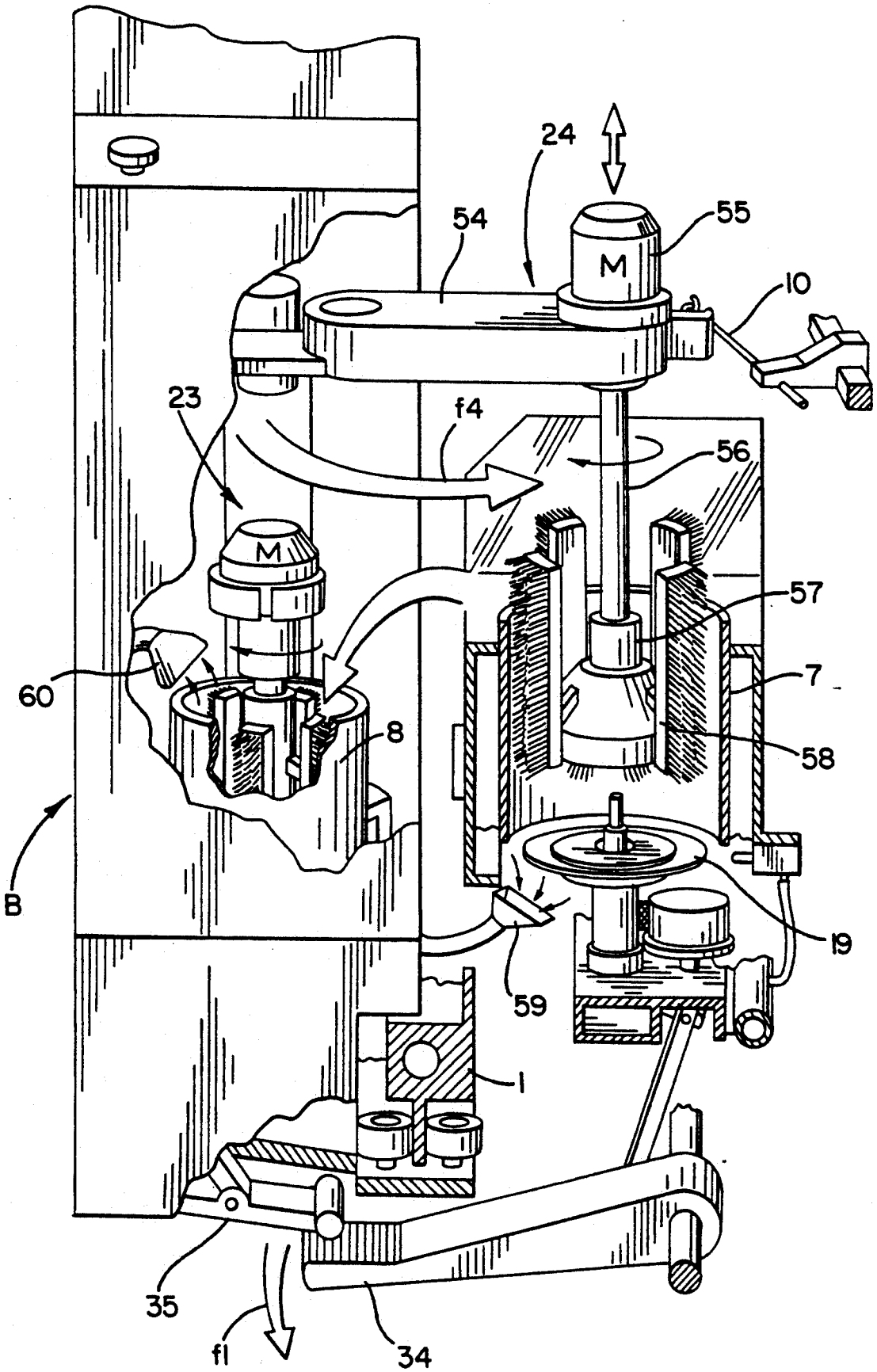
FIG. 4 is a view of parts substantially corresponding to the illustration of FIG. 3 with the cleaning devices in second operating positions.

FIGS. 3 and 4 illustrate an arrangement, which comprises, in addition to a first cleaning device 23, as has been described with reference to FIG. 2, a second cleaning device 24, which is provided for cleaning the balloon limiter 7.

Before proceeding with the description of FIG. 3, it should be mentioned that, when a cleaning device is moved in the region of the spindle axis, the balloon yarn guide 10 is removed from its position coaxial with the spindle.

FIG. 3 illustrates a condition, in which the protective pot s is removed from the balloon limiter 7 by the first cleaning device 23 in direction of arrow f2, so as to be swung subsequently in direction of arrow f3 into the interior of the automatic maintenance device B. After the protective pot s is removed from the region of the spindle, the second cleaning device 24, which is attached to a pivot arm 54, is moved in direction of arrow f4 out of the automatic maintenance device B above the spindle to be serviced or cleaned. This second cleaning device 24 comprises likewise a drive motor 55 to drive a shaft $6 with a hub 57, to which vertically arranged brush bars 58 are attached for cleaning the inside wall of the balloon limiter 7. This dirt- or air-laden air can be sucked away by means of a nozzle 59, which moves out of the automatic maintenance device B to the yarn storage disk 19, or by means of a suction device, as has been described for the cleaning device 23 with reference to FIG. 2. FIG. 4 illustrates an additional suction nozzle 60 arranged likewise in the interior of the automatic maintenance device B, so as to remove therein air laden with dust and dirt particles, while a protective pot s is cleaned. This suction nozzle 60 may be used in addition to, or as replacement for, the suction device described with reference to FIG. 2.

Figure 6:
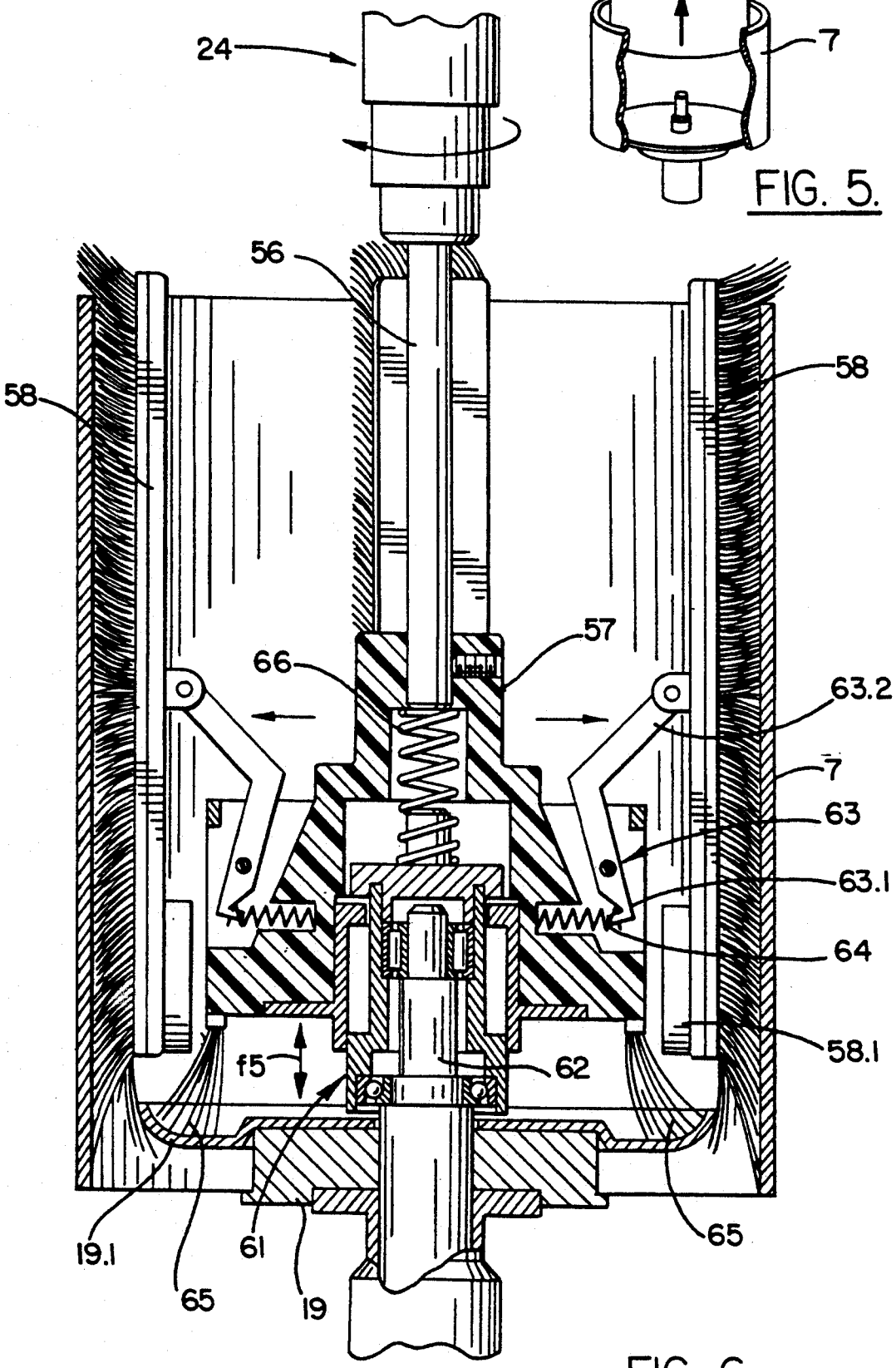
FIG. 6 is an axial sectional view of parts of a two-for-one twisting spindle with a cleaning device for cleaning the jacket of the balloon limiter.

FIG. 6 illustrates the special construction of a cleaning device used according to the present invention and/or in combination with an automatic maintenance device, as is also provided by the present invention. The cleaning device illustrated in FIG. 6 can be used as a cleaning device for both the protective pot s and the balloon limiter 7, as is especially shown in FIG. 6.

In the following description of FIG. 6 it is presumed that the cleaning device 24 is the one, which comprises a driven shaft 56 with a hub 57 arranged on the shaft end and brush bars 58 attached to the latter.

In order to ensure an accurate centering of the cleaning device inside the balloon limiter 7, the hub 67 is provided on its underside with a bearing block 61, onto which the upper portion of the spindle shaft 62 can be inserted.

The individual brush bar 58 is movably attached by means of a two-arm pivot lever 63 to the hub 57. Each pivot lever 63 is adapted to rotate about a horizontal axis, which is located such that the pivot lever can be pivoted in a radial plane relative to the spindle axis. The lower lever arm 63.1 is pressed outward by a compression spring 64, whereas the brush bar 58 is jointed substantially in the center of its length to the other, upper lever arm 63.2.

A mass of material 58.1 is arranged or provided on the lower end of each brush bar 58. This mass of material 58.1 causes, when the shaft 56 and thus the hub body 57 are rotated, the lower end of each brush bar 58 to first move outward by the action of the centrifugal force, so that also the lower bristles of each brush bar contact first the inside wall of the balloon limiter and move then downward into the gap between the balloon limiter and the standard guide plate 19.1 of the yarn storage disk 19. As the speed increases, the brush bar 58 is moved outward over its entire length, so that the balloon limiter 7 is cleaned over its entire height.

The underside of the hub body 57 accommodates additional, downward directed brushes or bristle elements 6$, which are provided to clean either the upper side of the yarn guide plate 19.1 or the bottom of a protective pot.

As soon as the shaft 56 is again stopped, the brush bars 58 retract inwardly by the action of compression springs 64, which are operative on the pivot levers 63.

The bearing block 61 is supported inside the hub body 57 to float in axial direction, and further supported relative to the hub body by a compression spring 66, so as to provide an adequate axial space for a movement between the spindle axis 62 and shaft 56 in the direction of double arrow f5, in order to eliminate damage in the region of the spindle shaft 62 or to the bearing of the spindle shaft 62, when the bearing block 61 is lowered onto the spindle shaft 62.

While the description of the construction of FIG. 6 omitted an illustration and description of suction devices, it is understood that a system according to FIG. 6 allows to associate suction devices either in form of a central suction nozzle 41 or in form of suction nozzles applied thereto from the side and in a way comparable to the suction nozzle 59 of FIG. 4.

It is also possible to use the cleaning device of the present invention independently of a maintenance automat, if need be, with an integrated drive motor or a drive motor, which can be coupled therewith.

What is claimed is:

1. A method of cleaning a yarn supply package protective pot of a spindle assembly of a two-for-one twister yarn processing machine having a plurality of such spindle assemblies mounted in a side-by-side relationship longitudinally of the machine with a maintenance device having a housing mounted for movement longitudinally along the machine to each of the spindle assemblies and cleaning means therein for cleaning the protective pot of each of the spindle assemblies including a gripper device for swinging in a horizontal direction out of and into the maintenance device housing and to move upward and downward and to grip and release the protective pot; said method comprising the steps of:

positioning the maintenance device at a selected spindle assembly of the machine;

moving the gripper device horizontally out of the maintenance device housing over the selected spindle assembly and downward into engagement with the protective pot;

gripping the protective pot with the gripper device;

moving the gripper device with the gripped protective pot upward out of the spindle assembly and horizontally into the maintenance device housing;

cleaning the protective pot with the cleaning means while in the maintenance device housing;

moving the gripper device with the gripped and cleaned protective pot horizontally out of the maintenance device housing over the selected spindle assembly and downward into the spindle assembly;

releasing the protective pot from the gripping device; and returning the gripping device to the maintenance device housing.

2. A method of cleaning a yarn supply package protective pot and a balloon limiter device of a spindle assembly of a two-for-one twister yarn processing machine having a plurality of such spindle assemblies mounted in side-by-side relationship longitudinally of the machine with a maintenance device having a housing mounted for movement longitudinally along the machine to each of the spindle assemblies and a first cleaning means therein for cleaning the protective pot of each of the spindle assemblies including a gripper device for swinging in a horizontal direction out of and into the maintenance device housing and to move upward and downward and to grip and release the protective pot and a second cleaning means therein for cleaning the balloon limiter device and being adapted to swing in a horizontal direction out of and into the maintenance device housing and to move upwardly and downwardly; said method comprising the steps of:

positioning the maintenance device at a selected spindle assembly of the machine;

moving the gripper device of the first cleaning means horizontally out of the maintenance device housing over the selected spindle assembly and downward into engagement with the protective pot;

gripping the protective pot with the gripper device;

moving the gripper device with the gripped protective pot upward out of the spindle assembly and horizontally into the maintenance device housing;

cleaning the protective pot with the first cleaning means while in the maintenance device housing;

moving the second cleaning means horizontally out of the maintenance device housing over the selected spindle assembly and downward into the balloon limiter device;

cleaning the balloon limiter device with the second cleaning mans while the protective pot is gripped and maintained out of the spindle assembly and in the maintenance device housing;

returning the second cleaning means to the maintenance device housing;

moving the gripper device with the gripped and cleaned protective pot horizontally out of the maintenance device housing over the selected spindle assembly and downward into the spindle assembly;

releasing the protective pot from the gripping device; and returning the gripping device to the maintenance device housing.

* * * * *